United States Patent [19]

Bierig

[11] Patent Number: 4,503,796

[45] Date of Patent: Mar. 12, 1985

[54] ROTATABLE SPAR

[76] Inventor: David A. Bierig, 955 W. 4th St., Erie, Pa. 16507

[21] Appl. No.: 365,019

[22] Filed: Apr. 2, 1982

[51] Int. Cl.[3] ..... B63H 9/06

[52] U.S. Cl. ..... 114/89; 114/103; 114/39

[58] Field of Search ..... 114/39, 89, 98, 102, 114/103, 97

[56] References Cited

U.S. PATENT DOCUMENTS

| | | | |
|---|---|---|---|
| 3,195,494 | 7/1965 | Robin | 114/89 |
| 4,263,861 | 4/1981 | Vicard | 114/39 |
| 4,276,033 | 6/1981 | Krovina | 114/103 |
| 4,365,570 | 12/1982 | Jamieson | 114/102 |

FOREIGN PATENT DOCUMENTS

| | | | |
|---|---|---|---|
| 2912867 | 10/1980 | Fed. Rep. of Germany | 114/98 |
| 984449 | 2/1951 | France | 114/102 |
| 160399 | 3/1921 | United Kingdom | 114/103 |
| 1074789 | 7/1967 | United Kingdom | 114/97 |

*Primary Examiner*—Trygve M. Blix
*Assistant Examiner*—Edwin L. Swinehart
*Attorney, Agent, or Firm*—Wayne L. Lovercheck; Charles L. Lovercheck; Dale R. Lovercheck

[57] ABSTRACT

A rotatable spar apparatus for controlling and adjusting sail shape which includes a curved, rigid spar which is arranged to reverse its curvature when tacking. Additionally by controlling the degree of rotation it may be used as a draft control device.

16 Claims, 28 Drawing Figures

FIG. 2
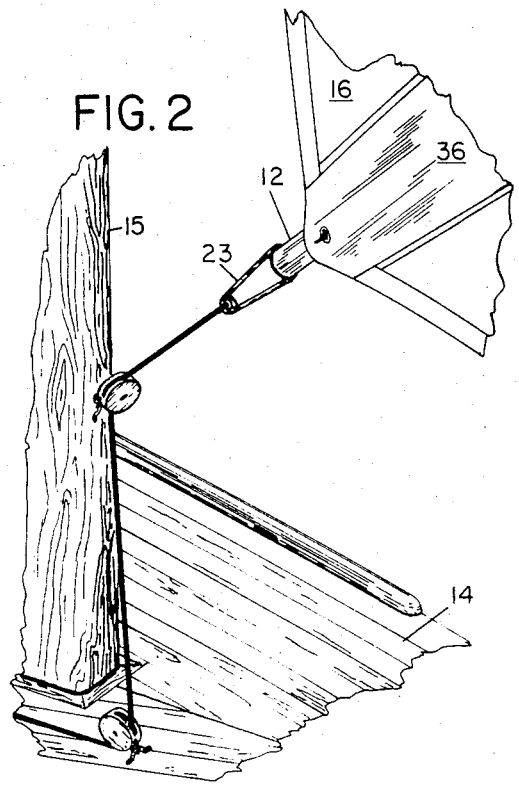
FIG. 3
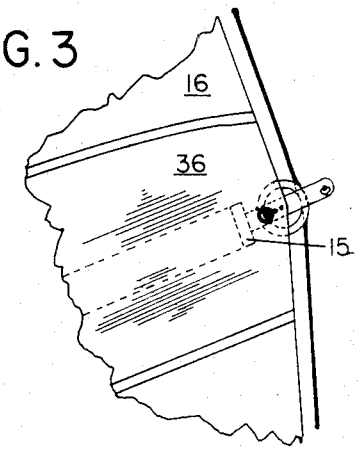
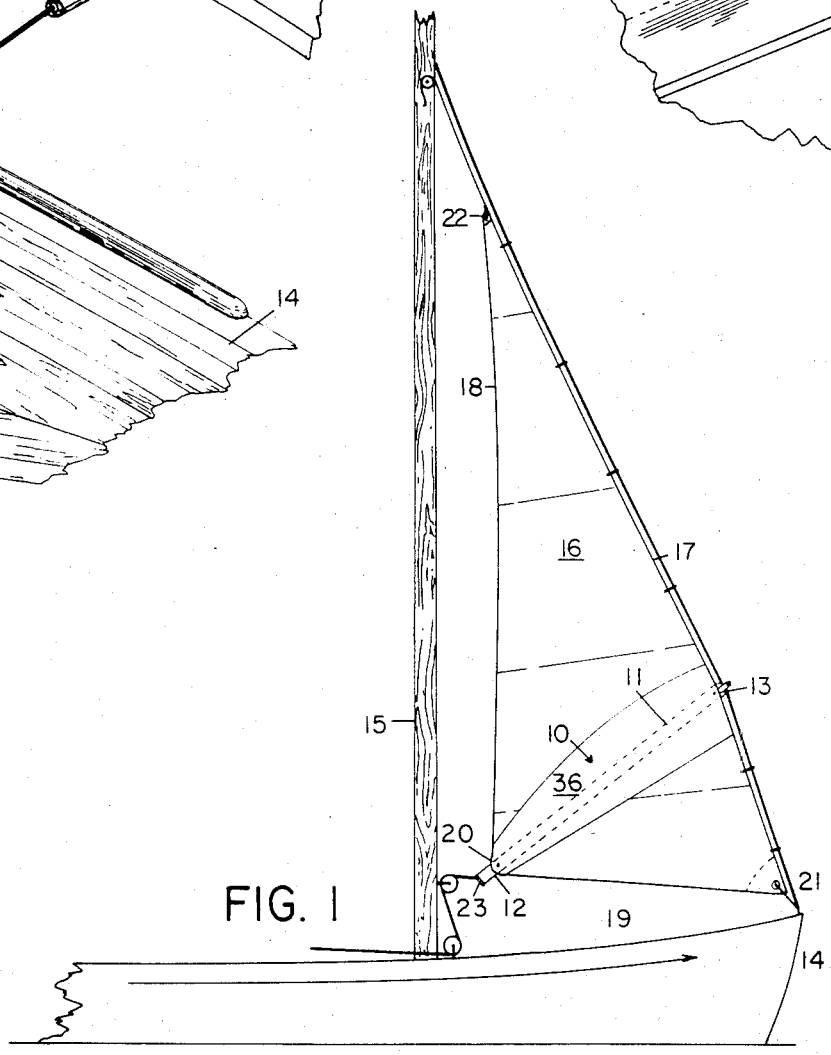
FIG. 1

FIG. 4
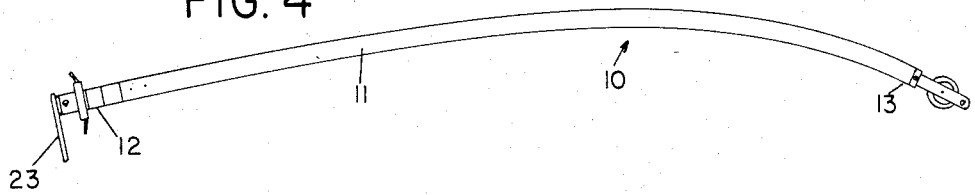
FIG. 5
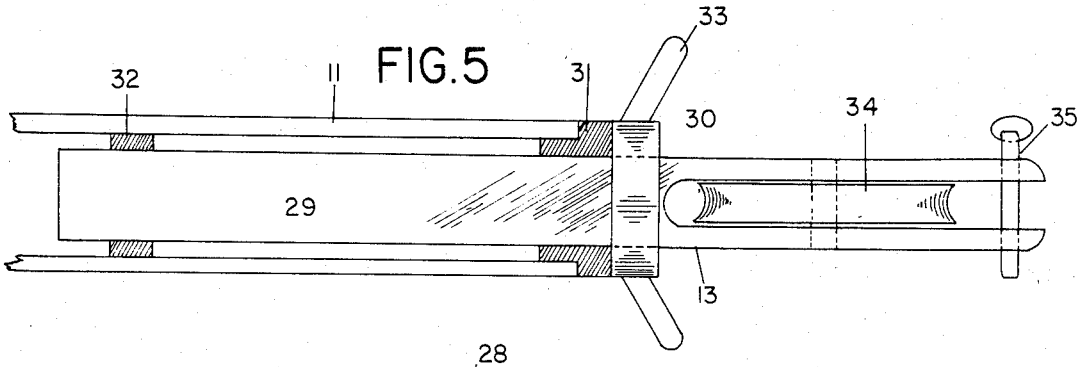
FIG. 6
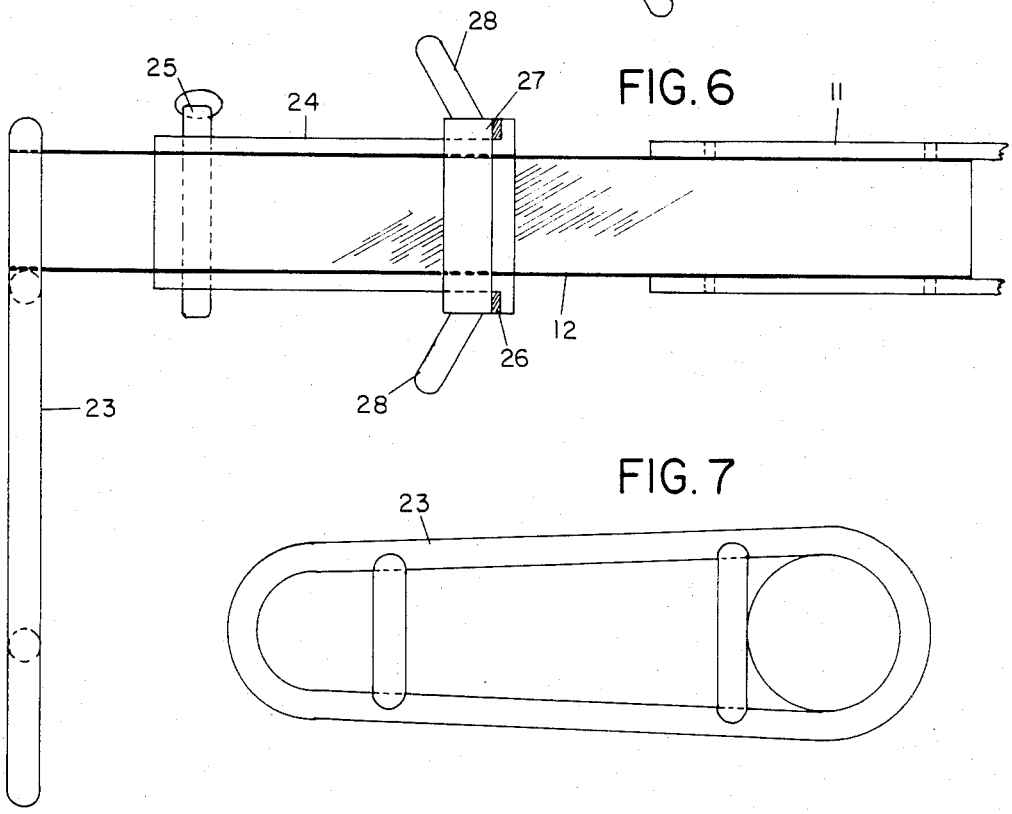
FIG. 7

ROTATABLE SPAR

BACKGROUND OF THE INVENTION

1. Field of the Invention

This invention relates to apparatus for controlling and adjusting sail shape, and particularly to a structure including a curved rigid spar which is arranged to reverse its curvature when tacking and which may be set at a controlled rotation as a draft control device.

2. Description of Prior Art

A problem fundamental to sailing and sailmaking is the control of sail shape. Basically, this amounts to designing a sail and rig (spars and control devices) with sufficient adjustability so that a sail can have a full, powerful, (large camber ratio) shape in light winds, or when reaching and running, and yet, be able to be progressively flattened, or "de-powered", as wind increases, or for sailing to weather (upwind). This is accomplished in mainsails by mechanically bending, or straightening, the mast, by adjusting the clew outhaul in or out, and by adjusting the sail in or out from the centerline of the boat. This generally works well, but does not do an entirely satisfactory job of controlling fully battened mains with large roach (excess cloth at leach). Here, increasing wind strength causes the battens to bend more, and the roach tends to move forward, both of which increase the draft of the sail when draft reduction is desired. With headsails in increasing wind, draft can be reduced to a point by increasing the luff tension in the sail, by sheeting the sail harder and moving the sheet lead outboard, and by increasing headstay tension to reduce luff sag. Ultimately though, these methods fail as wind strength increases to the point where headstay sag cannot be kept within the limits the sail was designed for. Then, a flatter (cut for more sag) and usually smaller headsail must be substituted. The converse is true with decreasing winds. Also, as wind strength increases, woven sailcloth tends to stretch in ways that increase sail draft. It should also be noted that present rig control systems require sailcloth stretch characteristics that are difficult to produce in new cloth, and are seldom present in sails that have been used a season or two.

A further sail shape control problem is the control of sail twist (angle of sail cord to centerline of boat at different elevations above the deck). While mainsail twist is controlled fairly well by travelers and vangs, little has been done to control twist in headsails when reaching or running.

The conventional method used to spread the foot of a mainsail, and some non-overlaping headsail is by attaching the foot of the sail to a boom, which is a straight spar pivoted at or near the forward lower corner (tack) of the sail. Another method, once used on small craft, was to run a straight spar from the clew of the sail to the mast, or forestay a few feet above the tack of the sail. This had an advantage in that it formed a structural triangle (spar and mast in compression and foot of sail in tension for mainsails) which prevented the clew of the sail from rising, and hence the sail from twisting excessively, when the sheet was eased. This then kept the sail in shape better than a boom attached to the foot of the sail. The disadvantage was that the airfoil shape of the sail was disrupted by this spar on one tack. To solve this shortcoming, Nathaniel Herreshoff and others devised the wishbone boom early in this century. This consisted of a pair of curved spars that surround the mast and sail.

With this arrangement, good sail control was achieved on both tacks, but there was a great deal of clutter and windage (parasitic drag) associated with this rig. This rig has been revived in recent years for some production boats such as the Freedom Ketches, the Stone Horse Sloop, and the Nonsuch Catboats. There is a simplification of the wishbone rig (by Phil Bolger and others) whereby only half of the wishbone is used. This half wishbone remains on one side of the sail and is supported by multiple topping lifts. It is always curved in the same direction, so that on one tack it lies close to the sail, and on the other tack it is bowed away from the sail. Even with this rig there is still a lot of windage.

Also, a conventional method of stiffening sails (usually for high speed sails for iceboats, land yachts, and multihulls) is to insert battens into batten pockets that run from the luff to the leech of the sail. These so called-full length battens are straight pieces of wood or fiberglass, or some similar material. Wind pressure is required to make the battens bend and allow the sail to assume a good shape. This generally works very well, but occasionally in light air the battens will not bend enough, and the heavy air shortcomings were noted above. Also, because the battens must be flexible, they are subject to breakage.

SUMMARY OF THE INVENTION

The new development is a rigid (or essentially rigid) curved spar within the sail in a pocket, or on the near surface of the sail, that is mechanically arranged to "flip over" when the sail is tacked, and that can be used as a draft control device by controling its degree of rotation. The curved spar remains within the pocket (or on the near surface of the sail if it is not in a pocket) on either tack. What we achieve then, when using this spar in place of a boom on a mainsail or headsail, is the advantage of the wishbone rig without the windage and clutter associated with it. When using this spar in place of full length battens, we achieve a more rigid sail and a better control of the sails cross sectional shape. Rigged in the simplest manner, the foot of the sail is always pulled tight and prevents the clew from rising and the sail from twisting. Often though, it is desirable to have more shape in the foot of the sail than this will allow. In this case, a line is rigged from the clew end of the curved spar forward to the mast (or headsail tack position) with sufficient tackle to tension this line to prevent sail twist and allow shaping of the lower portion of the sail.

Further, because we control the rotation of the curved spar, we can control the shape it imparts to the sail. That is, when the curved spar is horizontal, it imparts full curvature to the sail, and when it is rotated to the vertical position it imparts no shape to the sail, i.e., it makes the sail flat. In a fully battened type of sail, if we continue to rotate the spar (without tacking) so that it is bowed to weather we literally turn the sail inside out which has application to heavy air sailing as a last resort method of de-powering. To get full advantage of using the rotation of the spar to flatten a sail, the spar must have a mechanism to "outhaul" the sail as the spar rotates so that the overall length of the spar when it is in the vertical position is equal to its horizontal arc length measured along its curve. Outhauling can be accomplished by hydraulic rams, or by a threaded outhaul device, or by shifting the position of the forward end of the spar. (see drawings)

In headsails, we achieve self tacking, minimize windage (parasitic drag) from the boom/wishbone, and also we eliminate twist in the sail as the sheet is eased. Further, because the curved spar thrusts forward on the headstay (the stay to which the luff of the headsail is attached) we prevent the stay from sagging aft and increasing the draft of the sail. Thus the sail is effective over a wider wind range. This is the opposite of a conventional rig where increase in wind strength increases stay sag and sail draft (which is exactly what you do not want). Also, by controling the degree of rotation of the spar, we can control sail draft.

In mainsails, we achieve self tacking, eliminate the windage of the wishbone, and also eliminate twist in the sail as the sheet is eased. Also, by controling the degree of rotation of the spar, we can control sail draft.

For full length battens, we can now use pre-curved rigged spars instead of battens. This in an aid to sail shaping, and also allows the sail to take the desired shape even in very light air. Further, by controling rotation, we can control sail shape and regulate it from full draft to flat to inside out. A further advantage is that sails with large roach (convex curvature of the after edge) can be more easily controlled and put less demanding loads on the sailcloth.

BRIEF DESCRIPTION OF THE DRAWING

FIG. 1 is a side view of the curved rigid sail stiffener as it would be used in a first embodiment of the invention adapted to engage a jib.

FIG. 2 is a side view of a first end of the sail stiffener according to the embodiment of the invention.

FIG. 3 is a side view of a second end of the sail stiffener according to a first embodiment of the invention.

FIG. 4 is a view of the spar member showing the curvature thereof.

FIG. 5 is a detailed view of the second end of the spar.

FIG. 6 is a detailed view of the first end of the spar.

FIG. 7 is an end view of the first end.

DESCRIPTION OF THE PREFERRED EMBODIMENTS

Figure 9:
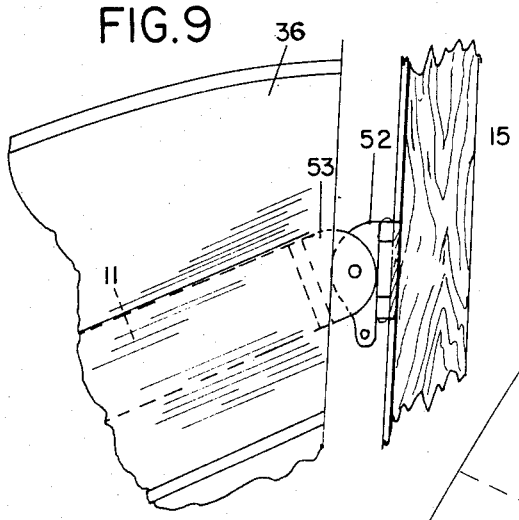
FIG. 9 is an enlarged view of the second end of the mainsail spar.
Figure 8:
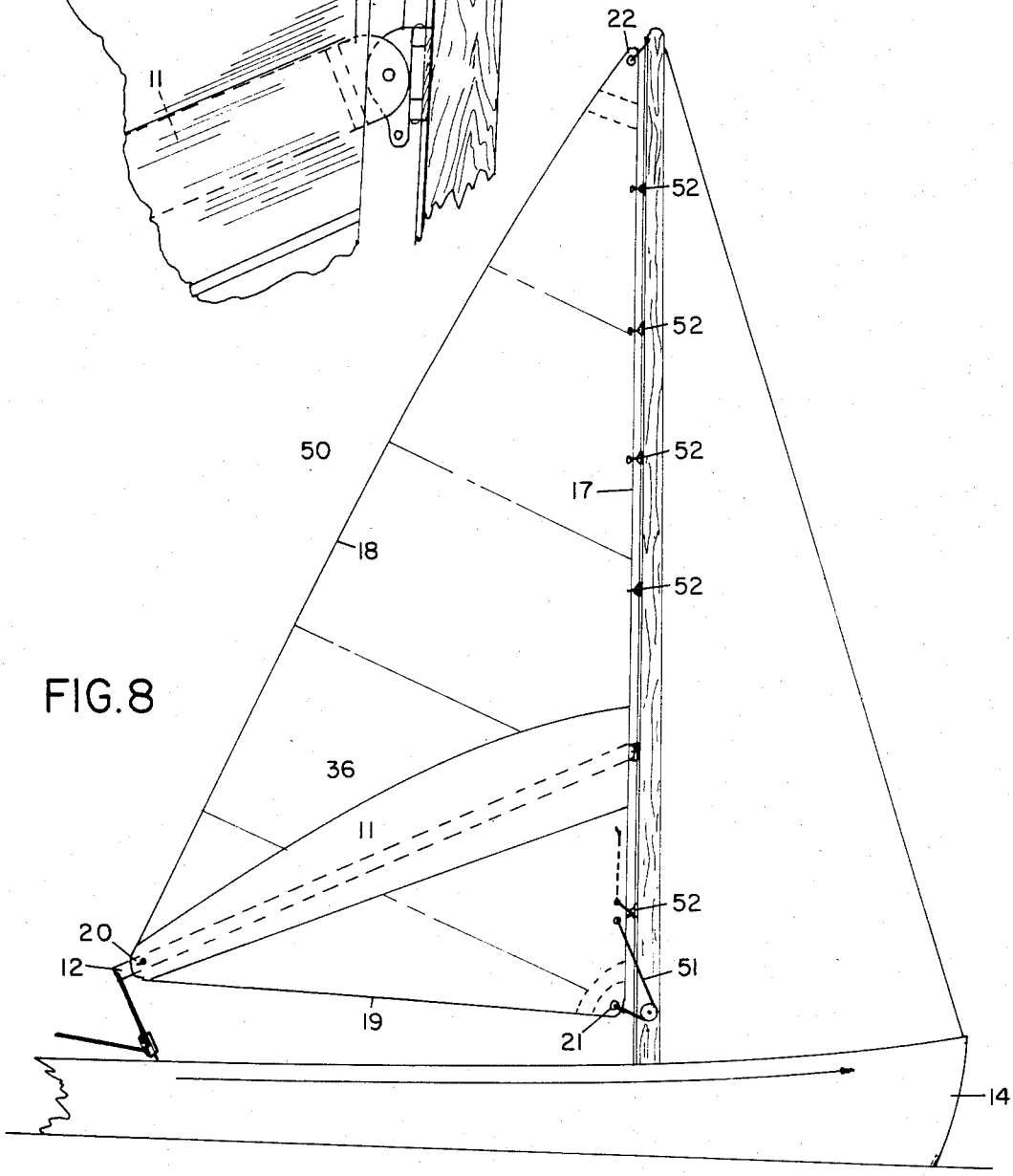
FIG. 8 is a side view of the rotatable spar as it would be used in a second embodiment of the invention adapted to engage a mainsail.
Figure 10:
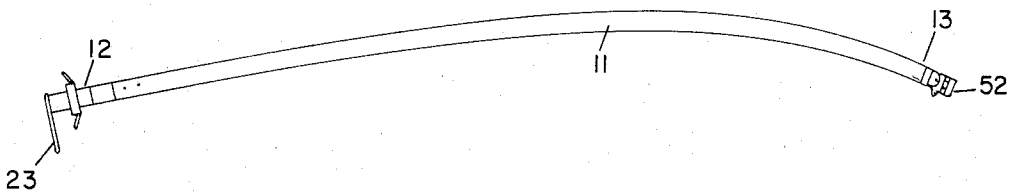
FIG. 10 is a view of the mainsail spar showing the curvature thereof.
Figure 11:
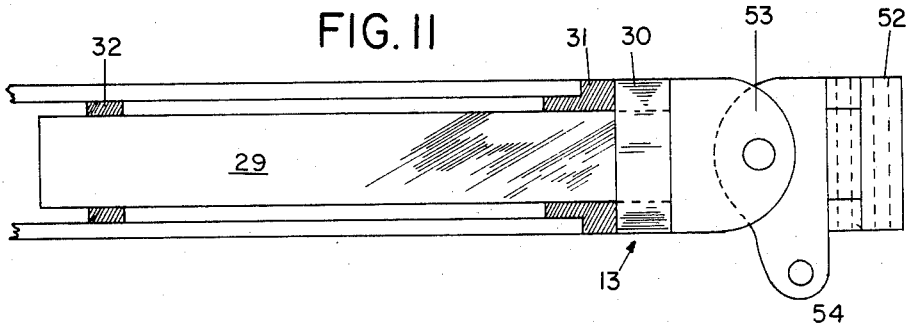
FIG. 11 is a side view of the second end of the mainsail spar.
Figure 12:
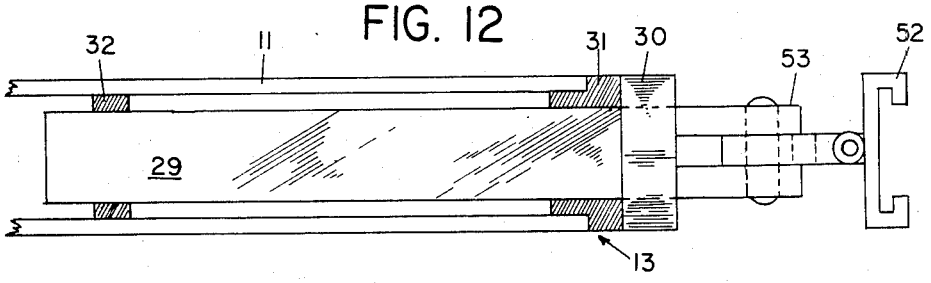
FIG. 12 is a top view of the second end of the mainsail spar.
Figure 13:
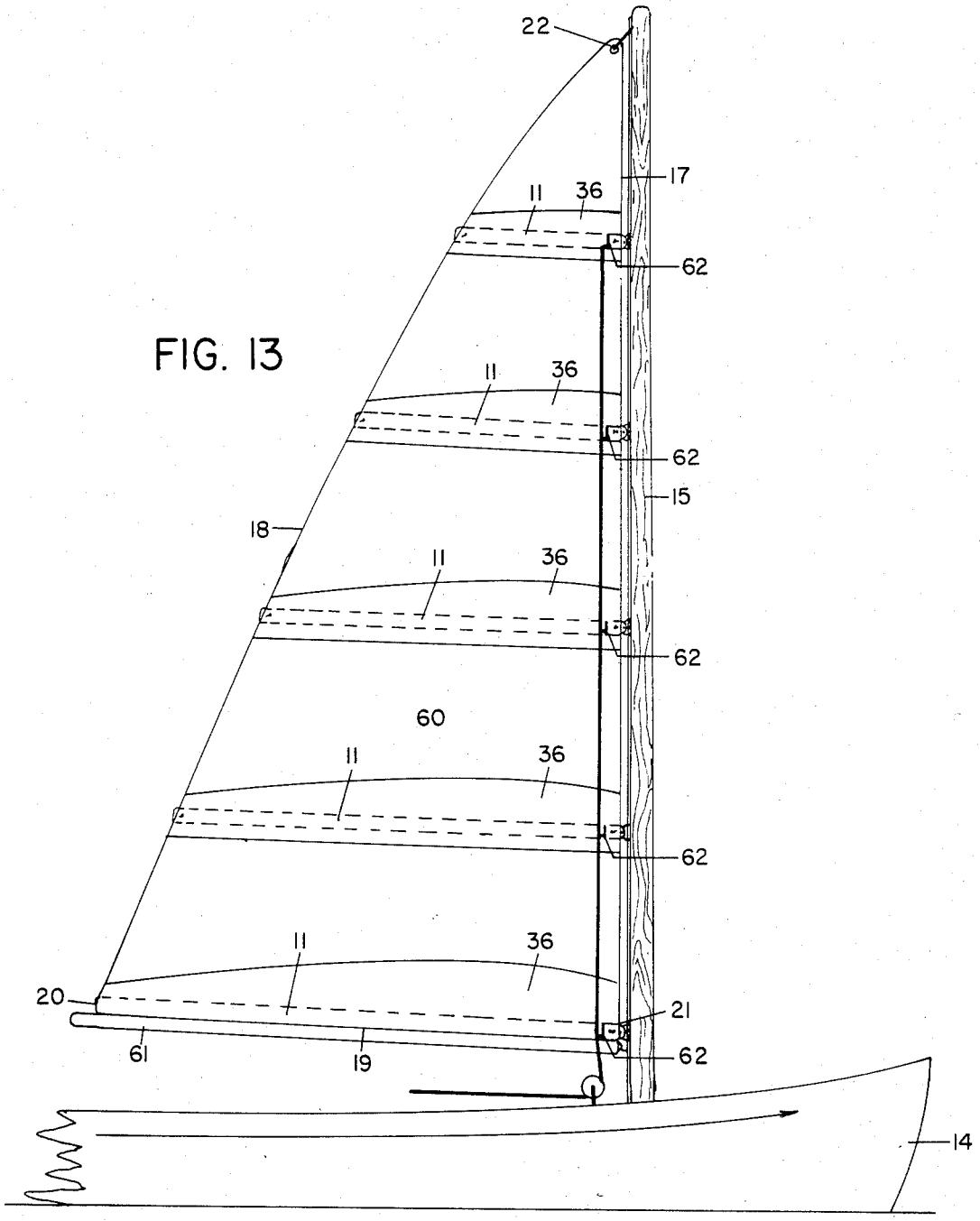
FIG. 13 shows the use of multiple rotatable spars according to a third embodiment of the invention.
Figure 14:
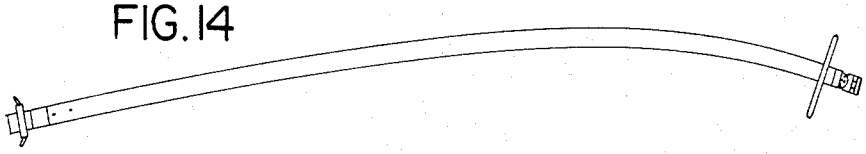
FIG. 14 is a view of the multiple spar member with a mainsail type slide/gooseneck and with double tacking arms attached to the rotating tube of the spar.
Figure 15:
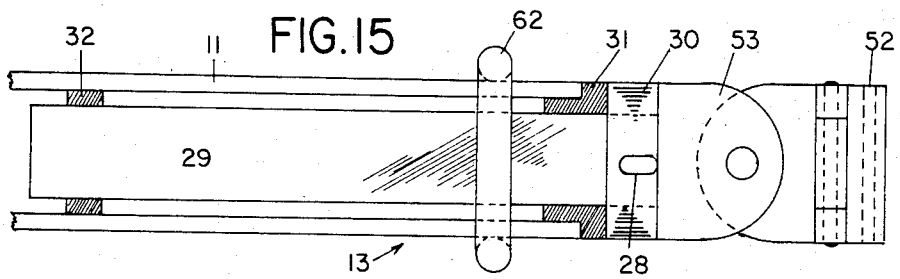
FIG. 15 is an enlarged side view of the second end of the multiple spar member embodiment shown in FIG. 14.
Figure 16:
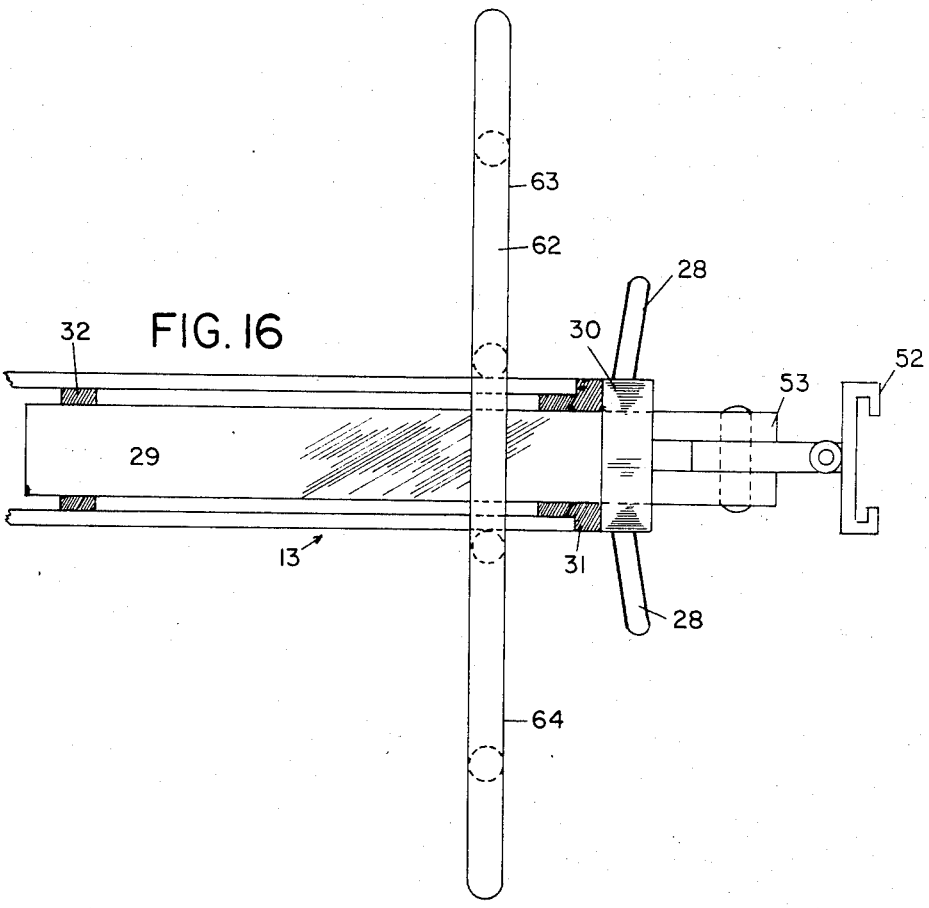
FIG. 16 is an enlarged top view of the second end of the multiple spar embodiment shown in FIG. 14.

Now with more particular reference to the drawings, a spar apparatus is disclosed generally indicated at 10. The spar apparatus is made up of a spar 11 which has a first end 12 and a second end 13. The spar 11 is curved along its length to a predetermined shape representing maximum curvature of the sail. In a sail propelled vehicle such as a boat 14, having a mast 15, and a sail 16, having a luff 17, a leach 18, a foot 19, a clew 20, a tack 21, and a head 22.

The first end 12 in the form of a short rod includes a tacking arm 23 rigidly attached to the extreme first end of the spar 11. The tacking arm 23 rotates the spar 11 when the boat is tacked. An end view of the tacking arm 23 is shown in FIG. 7. The first end 12 also includes a flanged sleeve 24 which is slidably fit over the end of the spar 11 and can be moved fore and aft over a predetermined range of adjustment and may be fixed in the correct position by a fast pin 25. A thrust bearing 26 is provided adjacent the flanged sleeve 24 to allow free rotation of the spar relative to the thrust collar 27. The thrust collar 27 is provided with horns 28 adapted to fit through the clew grommets of the sail 16.

The second end 13 of the spar 11 may be made by inserting an inner tubular member 29 into the main tube of the spar 11 being adapted to permit the spar to rotate relative to the inner member. The rotation is permitted by the thrust collar 30 which cooperates with the forward thrust bearing 31 and the after bearing 32. Horns 33 are provided on the second end 13 to fit into grommets set along the luff of the sail. A headstay sheave 34 is provided at the forward end of the inner member 29 to engage the headstay. A fast pin 35 may be provided to keep the spar attached to the headstay. A spar 11 is curved along its length to a predetermined curvature which is imparted to the sail 16 by the spar 11 as the wind force holds the sail against the spar. By providing a means to rotatably attach the sail to the spar the spar can be used to "depower" the sail as well. In a preferred embodiment the spar 11 may be adapted to rotate inside a pocket 36 in the sail 16.

In another embodiment of the invention wherein the spar 11 is adapted to be used in a mainsail 50 the first end 12 is constructed in the same manner as described above. The second end 13 which in a mainsail application will be adjacent the mast and attached thereto may be constructed as follows: the second end 13 is also very similar to the first embodiment except that there is a luff slide 52 to fit a mast track and a gooseneck fitting 53 which performs the same function as the headstay sheave on the first embodiment. A hole 54 is provided for attaching a downhaul to the gooseneck fitting. Alternatively horns 28 could be used on the thrust collar 30 as in the first embodiment to engage grommets in th sail at the luff if a downhaul is not rigged. A triangle is formed by the spar member 11 at the clew 20, the lower luff and the foot 19. Since the after end of the spar 11 must move aft as it is lowered and in this arrangement the foot of the sail prevents this, a jack line 51 is rigged to all luff slides 52 located below the spar 11 and rigged to the mainsail tack. The jack line 51 allows the sail 50 and the spar 11 to move aft and thus the sail to be lowered.

In a third embodiment a full length batten sail 60 may be implemented by providing a plurality of generally parallel spars 11 over its length. Each of the spars 11 may be adapted to rotate within a pocket 36 in the sail 60. A conventional boom 61 is adapted to carry the clew of the sail in this embodiment. The spars 11 are used in their usual orientation and construction except that the tacking arm 23 is moved to the second end 13 adjacent the mast 15. In this embodiment a double tacking arm 62 may be provided attached to the second end 13 of the spars 11. The double tacking arm 62 extends outwardly with a first arm 63 and a second arm 64 oppositely disposed from each other and forming a tee with the end of the spar. The first arms 63 may be linked together with a first control line 80 and the second arms 64 may be linked together with a second control line 81 so that all the spars 11 may be rotated at once. The first end 12 of the spars is identical in configuration to the first end 12 of the spars 11 in the first two embodiments except for the omission of the tacking arm 23. The second end 13 is identical in configuration to the second end 13 of the spar 11 in the mainsail embodiment with the addition of the tacking arm 23 or the double tacking arm 62. The second end 13 being adjacent the mast and attached thereto is constructed as follows: luff slides 52 to fit a mast track and a gooseneck fitting 53 which performs the same function as the headstay sheave in the first embodiment. Horns 28 may be provided on the thrust collar 30. The forward thrust bearing 31 and an after bearing 32 permit the rotation of the spar 11 in relation to the inner member 29.

Figure 17:
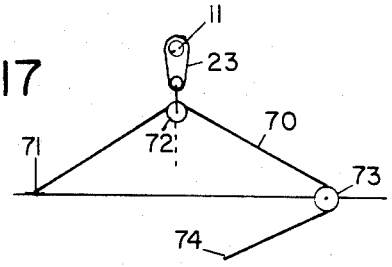
FIG. 17 shows a method of controlling rotation for mainsails or jibs with the sheet line pulled tight and the rotatable spar vertical according to a fourth embodiment of the invention.
Figure 18:
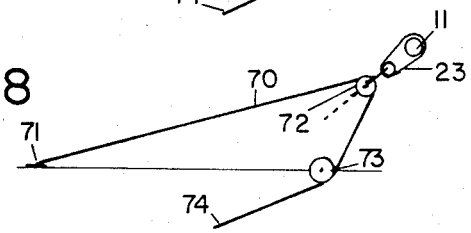
FIG. 18 shows the method of controlling rotation for mainsails or jibs with the spar at a 45 degree angle.
Figure 19:
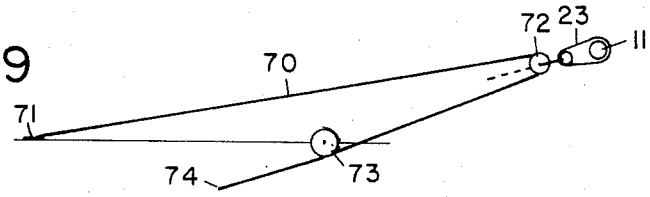
FIG. 19 shows a method of controlling rotation for mainsails or jibs wherein the sheet is eased far out and the spar is nearly horizontal.
Figure 20:
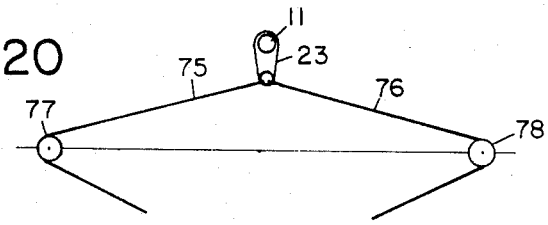
FIG. 20 shows a method of controlling rotation for mainsails or jibs according to another embodiment of the invention using a sheet from each side of the boat.
Figure 21:
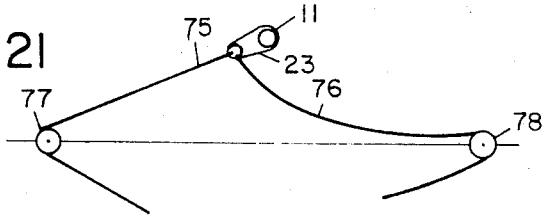
FIG. 21 shows the method of controlling rotation according to the second embodiment and shows how rotation is controlled by the relative tension in the two sheets.
Figure 22:
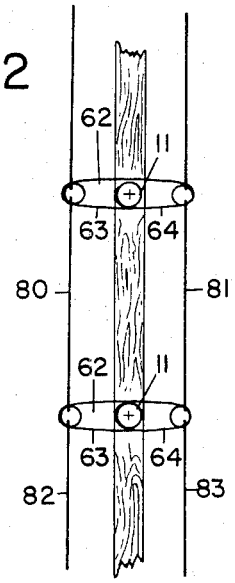
FIG. 22 shows the double tacking arms of the rotatable spar connected with control cables with the spar at a neutral position.
Figure 23:
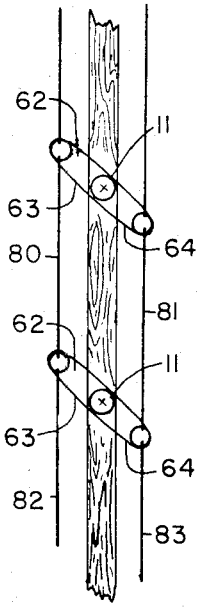
FIG. 23 shows the double tacking arms of the rotatable spar with control cables with the spar in a partially rotated position.
Figure 24:
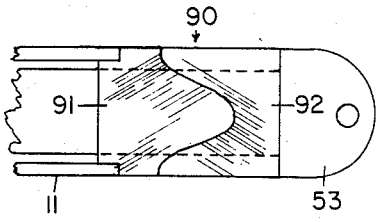
FIG. 24 illustrates a method of outhaul according to a fifth embodiment of the invention in its shortened position.
Figure 25:
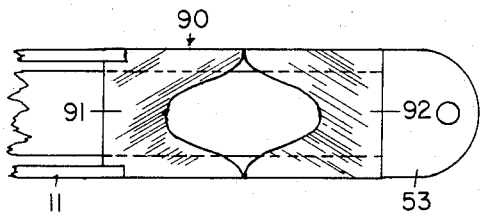
FIG. 25 shows a method of outhaul according to an embodiment of the invention in its fully extended position.
Figure 26:
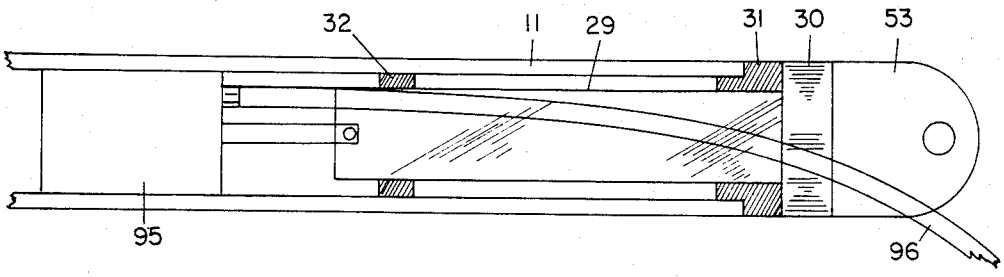
FIG. 26 shows an arrangement for outhauling a group of rotatable spars according to the fifth embodiment of the invention.

In a fourth embodiment of the invention we are controlling sail cross-section by controlling the degree of rotation of the spar member 11. The main concern is controlling the rotation when close hauled (sails pulled in close to the centerline of the boat). When a single tacking arm 23 is employed rotation may be controlled as shown in FIGS. 17, 18 and 19 by means of a sheet line 70 secured at 71 passing through a block 72 on the tacking arm 23 and then through another block 73 and from there to the end 74 which may be secured to a cleat or winch. In FIG. 17 the sheet line 70 is shown pulled tight and the curvature of the spar 11 is vertical, that is the spar imparts no curvature to the sail at all. FIG. 18 shows the sheet 70 somewhat slackened and the spar 11 has been rotated to a 45 degree angle and is imparting to the sail approximately half of the curvature of the spar 11. FIG. 19 shows the sheet 70 eased far out and the spar 11 is in a nearly horizontal position. This sheeting method will automatically adjust the rotation of the spar 11 as a function of angle to boat centerline. In an alternative sheeting method as shown in FIGS. 20 and 21 a first sheet 75 is attached to the tacking arm 23 and run through a first block 77 and the second sheet 76 is run through a second block 78. The first block 77 and the second block 78 being disposed on opposite sides of the boat. Again the rotation of the spar 11 is controlled by the slacking or tightening of the sheets 77 and 78.

In the embodiment employing multiple spars 11 in conjunction with the double tacking arm 62, the first arms 63 are linked by a first sheet 80 and the second arms 64 are linked by the second control line 81. The first end 82 of the first control line 80 may be suitably attached to a cleat or winch and the second end 83 of the second sheet 81 may be suitably attached to a cleat or winch. The rotation of the spar members 11 is controlled by the tightening or easing of the first sheet 80 and the second sheet 81 to obtain the desired degree of rotation of the spars 11.

Herein we have shown arrangements for using a curved spar 11 as a means to control the shape of a sail by turning the curved spar 11 to various degrees of rotation. When the curve of the spar is horizontal it imparts a maximum curvature to the sail and when the curve is vertical it imparts no curvature to the sail whatsoever.

In controlling sail curvature to obtain the maximum benefit the spar must be outhauled in some manner as it is rotated from horizontal to vertical. This is because in the horizontal position the sail is spread by the arc length of the spar, while in the vertical position it is only spread by the straight line length of the spar. Thus, to keep the sail taut, we must outhaul by the distance equal to arc length minus straight length when rotating from horizontal to vertical.

In a fifth embodiment of the invention a suitable method of outhaul may be provided by inserting a threaded thrust bearing 90 which may be inserted at a first end 12 of the spar 11. A first threaded member 91 may be attached to the first end 12 of the spar 11 rigidly affixed to the inner member 209 and a second thread member 92 may be rigidly attached to the thrust collar 27. As the spar 11 is rotated through an arc of 90 degrees the outhaul mechanism will expand from minimum length to maximum length. This minimum to maximum length will be achieved for clockwise and counterclockwise rotations through an arc of 90 degrees.

In an alternative outhaul embodiment a hydraulic cylinder 95 may be affixed to the second end 13 of the spar 11. Fluid to the cylinder being supplied by a hydraulic hose 96 from conventional fluid supply means. The hydraulic cylinder being adapted to increase the length of the spar 11 by outhauling the sail through a predetermined increase in length to assist in controlling the shape of the sail.

Figure 27:
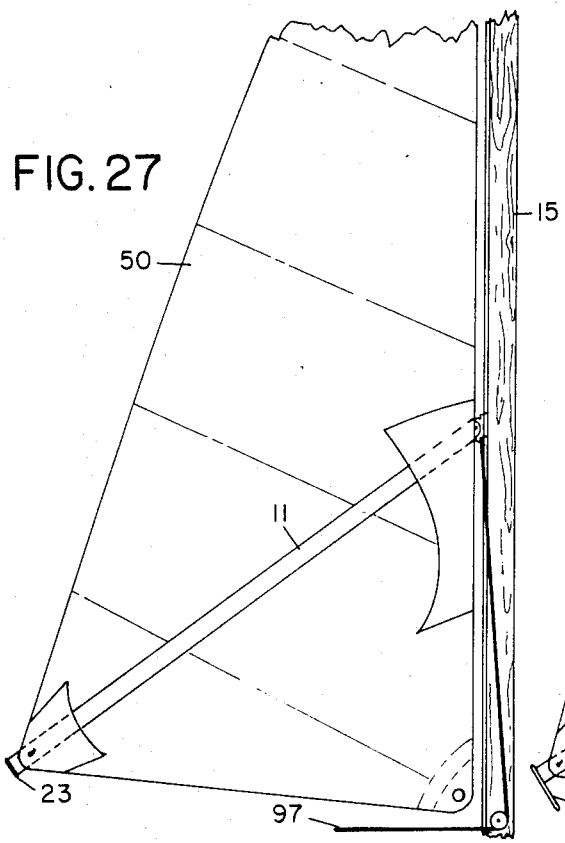
FIG. 27 shows a method of outhauling a mainsail or a jib spar according to the fifth embodiment of the invention.
Figure 28:
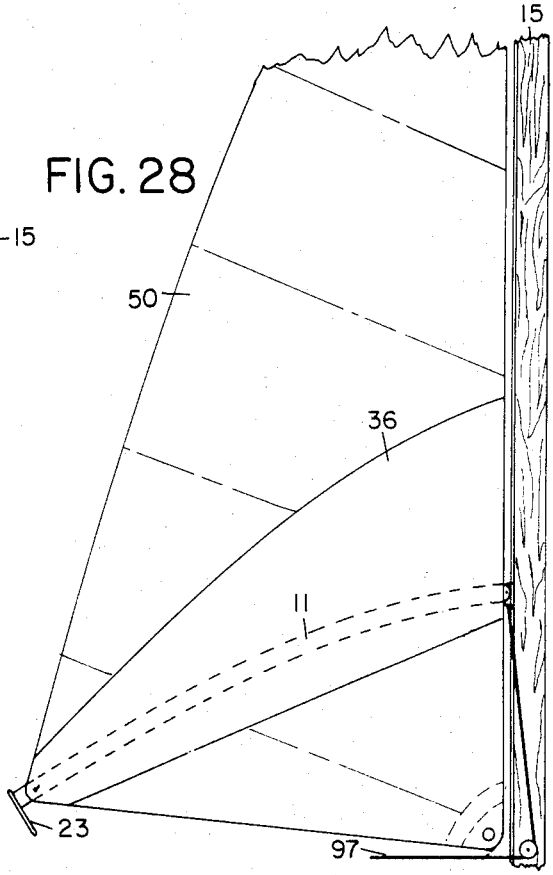
FIG. 28 shows a method of outhauling a mainsail of a jib spar according to the fifth embodiment of the invention.

FIGS. 27 and 28 show a method of outhauling either a mainsail or a jib type spar 11. This method could also be used with the multi-spar embodiment if the spars 11 are lying at less than 90 degrees to the mast. In the case of the jib, the forward end of the spar 11 must be above a line drawn perpendicularly from the clew to the luff. The forward end of the spar 11 is not pinned to the luff 17 of the sail, but is left free to move up and down in a wide pocket 36. In a mainsail or jib application the spar 11 lies above the line perpendicular to the luff from the clew and it will tend to rise up the mast 15 and is restrained by a downhaul 97. By hauling the forward end of the spar downwardly, we force the after end aft away from the mast and thus outhaul the sail. In a multiple spar application, the spars 11 lie below the line perpendicular to the luff from the clew and the spar 11 will tend to move down the mast and is restrained by an uphaul. By hauling the forward end up we force the after end away from the mast thus outhauling the sail.

As is shown in FIG. 28, the rotatable spar 11 may be placed inside a pocket in the sail 50, that is, sail cloth being provided about both sides of the spar. As is shown in FIG. 27 the rotatable spar 11 may also be used without a pocket in the sail, with only minor losses in terms of windage and sail control. An alternative to the sail pocket which would retain the control advantages of the pocket would be a series of straps horizontally spaced and vertically disposed. The straps are attached to the sail at both ends by conventional means and provide for the spar to be contained between the straps and the sail. This arrangement will leave the spar free to rotate and will maintain the position of the sail adjacent the spar.

The foregoing specification sets forth the invention in its preferred, practical forms but the structure shown in capable of modification within a range of equivalents without departing from the invention which is to be understood is broadly novel as is commensurate with the appended claims.

The embodiments of the invention in which the Applicant claims an exclusive right or privilege are as follows:

1. In combination a sail and a spar,
said sail having a leech, luff and foot,
said spar having a first end and second end and being curved therebetween,
said sail having a pocket therein extending from said leech to said luff of said sail,
said spar being in said pocket,
said pocket being wide enough to allow said spar to rotate 180° without lifting said sail,
means on said first end of said spar to rotatably support said first end of said spar on said leech of said sail and bearing means on said second end of said spar to rotatably attach it to said luff to said sail whereby said spar will rotate during tacking,
said spar comprises a tubular member and said bearing means on said second end of said spar comprises a second tube extending into said tubular member,
a collar on said second tube and a thrust bearing on said tubular member engaging said tubular member.

2. The combination recited in claim 1 wherein said sail has a plurality of vertically spaced generally parallel pocket means thereon and a plurality of said spars are received in said pocket means and rotatably attached to said lech and said luff of said sail.

3. The combination recited in claim 1 wherein said bearing means on said second end, has a sheave thereon which is adapted to ride on the headstay of said sailboat.

4. In combination a sail and a spar,
said spar comprising a tubular member,
said sail having a leech, luff and foot,
said spar having a first end and second end and being curved therebetween,
said sail having a pocket therein extending from said leech to said luff of said sail,
said spar being in said pocket,
said pocket being wide enough to allow said spar to rotate 180° without moving the sail vertically,
first bearing means on said first end of said spar to rotatably support said first end of said spar,
said first bearing means having first fastening means to fasten said first bearing means to said leech,
second bearing means on said second end of said spar,
second fastening means on said second bearing means to rotatably support said spar on said luff whereby said spar will rotate when said sail tacks,
said first end of said spar has a short rod rigidly attached to the inside of said tubular member extending outwardly therefrom, and a rotating means fixed to said short rod.

5. The combination recited in claim 4 further comprising a flange sleeve fitted over said short rod to provide an initial outhaul adjustment.

6. An apparatus for controlling sail shape which comprises: a sail having a pocket therein extending generally across the sail, a spar being in said pocket, said spar having a first end and a second end, first means for rotating at the first end of the spar, second means for rotating at the second end of the spar, said spar comprising a curved, substantially rigid member, said pocket being wide enough to allow said spar to rotate 180° without moving said sail vertically, said second rotating means being adapted to engage a headstay or the mast and having second bearing means on said second end of said spar to rotatably support said second end of said spar, said second bearing means having second fastening means thereon adapted to fasten said second bearing means to said sail at a second edge of said sail, said first rotating means having first bearing means on said first end of said spar to rotatably support said first end of said spar, said first bearing means having first fastening means thereon adapted to fasten said first bearing means to said sail at a first edge of said sail, said first rotating means also having an arm at its outer end being adapted to engage a sheet, the spar being rotatable along its length between the first rotatable means and the second rotatable means, the arm being adapted to rotate the spar whereby said shape is provided on either tack.

7. The apparatus for controlling sail shape as recited in claim 6, in which the spar is adapted to control a jib,
the jib having a foot, and a luff,
the spar, the jib foot, and the lower portion of the luff forming a triangle whereby the sail is prevented from twisting out of shape when a sheet is eased.

8. The apparatus of controlling sail shape as recited in claim 6 wherein the second rotating means further comprises a tube, a thrust collar on the tube, a forward thrust bearing adapted to engage the thrust collar, the thrust bearing being supported on the spar, an after bearing supported on the spar in engaging relation with the tube.

9. The apparatus for controlling sail shape as recited in claim 6 wherein the first rotating means further comprises a flanged sleeve rotatably positioned on the first end of the spar, a thrust collar is attached to the sleeve, a thrust bearing is attached to the spar adjacent to the sleeve to allow free rotation of the spar within the thrust collar.

10. A spar apparatus adapted to be received in a pocket in a sail having a first edge and a second edge comprising:

a sail having a pocket wide enough to receive said spar and to allow said spar to rotate 180° in said pocket without moving said sail vertically, said spar having a first end and a second end and a curve formed in said spar between said first end and said second end, said spar having first bearing means rotatably receiving said first end of said spar, said spar having second bearing means rotatably receiving said second end of said spar, said first bearing means having first fastening means thereon adapted to fasten said first bearing means to said sail at a first edge of said sail, said second bearing means having second fastening means thereon adapted to fasten said second bearing means to said sail at a second edge of said sail, said spar extending generally across the sail from said first edge to said second edge, rotating means fixed to said first end of said spar for rotating said spar, and attaching means adapted to attach said rotating means to a boat whereby said spar will rotate relative to said sail when said sail is tacked.

11. The spar recited in claim 10 wherein a plurality of said spars are provided, said spars being adapted to be vertically spaced and generally parallel to each other along the length of said sail.

12. The spar recited in claim 10 wherein said sail is a jib.

13. The spar recited in claim 10 wherein said sail is a mainsail.

14. The spar recited in claim 10 wherein said spar further comprises: outhaul means whereby as the curvature of the sail is adjusted while sailing, the sail is kept taut.

15. The spar recited in claim 10 wherein said spar is a tubular member and said first and said second bearing means are received on the first end and second end of said tubular spar.

16. In combination a sail and a curved spar, said sail having a first edge, a second edge, said first edge and said second edge comprising a leech, and a luff, said spar having a first end and second end and being curved therebetween, said sail having a pocket therein extending substantially from said leech to said luff, said pocket being wide enough to allow said spar to rotate 180° without lifting said sail, said spar being in said pocket, first bearing means on said first end of said spar for rotatably supporting said first end of said spar, first fastening means on said first bearing means fastening said first bearing means to said leech of said sail, second bearing means on said second end of said spar, second fastening means on said second bearing means fastening said second bearing means to said luff of said sail whereby said spar will rotate during tacking, rotating means fixed to said first end of said spar and means for connecting said rotating means to a boat whereby said spar can be rotated to control the shape imparted to said sail.

* * * * *